United States Patent [19]

Vreeland

[11] Patent Number: 4,749,445

[45] **Date of Patent: * Jun. 7, 1988**

[54] METHOD OF FINISHING PAPER UTILIZING SUBSTRATA THERMAL MOLDING

[75] Inventor: Jay H. Vreeland, Prince's Point, Me.

[73] Assignee: S. D. Warren Company, Philadelphia, Pa.

[ * ] Notice: The portion of the term of this patent subsequent to Nov. 25, 2003 has been disclaimed.

[21] Appl. No.: 881,867

[22] Filed: Jul. 3, 1986

Related U.S. Application Data

[63] Continuation of Ser. No. 611,766, May 18, 1984, Pat. No. 4,624,744.

[51] Int. Cl.[4] ..... D21F 11/00; D21G 1/00; B05D 3/12

[52] U.S. Cl. ..... 162/206; 100/93 RP; 427/361; 427/366

[58] Field of Search ..... 162/206, 361; 100/38, 100/93 RP, 162 R; 427/361, 365, 366; 118/60

[56] References Cited

U.S. PATENT DOCUMENTS

| | | | |
|---|---|---|---|
| 3,124,480 | 3/1964 | Mahoney et al. | 118/60 |
| 3,124,504 | 3/1964 | Mahoney et al. | 162/206 |
| 3,230,867 | 1/1966 | Nelson | 100/93 RP |
| 3,254,593 | 6/1966 | Beachler | 100/38 |
| 3,268,354 | 8/1966 | Hain | 427/366 |
| 3,442,685 | 5/1969 | Lohnas et al. | 118/60 |
| 3,451,331 | 6/1969 | Fredrickson et al. | 100/162 R |
| 3,647,619 | 3/1972 | Mack et al. | 162/206 |
| 3,759,785 | 9/1973 | Mihelich | 162/206 |
| 3,873,345 | 3/1975 | Vreeland | 117/65.2 |
| 4,012,543 | 3/1977 | Ranger et al. | 427/365 |
| 4,277,524 | 7/1981 | Nakajima et al. | 427/366 |
| 4,317,849 | 3/1982 | Ogura et al. | 427/366 |
| 4,606,264 | 8/1986 | Agronin et al. | 100/38 |
| 4,624,744 | 11/1986 | Vreeland | 162/206 |

OTHER PUBLICATIONS

Agronin, Ronald D., "The Effect of Supercalender Roll Fillings on Paper Printability." *TAPPI Publication, vol. 61, no. 9 (Sep., 1978). pp. 73–76.*

Agronin, Michael, "Supercalender Variables Affecting Paper Quality." *TAPPI Journal* (Oct. 1983), pp. 96–99.

Back, Ernest L. and Olsson, Anne-Mari, "The Effect of Temperature on Gloss Calendering of Board as Evaluated in a Press Simulator." 1981 Paper Finishing and Converting Conference, pp. 63–75.

Back, Ernst L. and Olsson, Anne-Mari, "The Effect of Temperature on Gloss Calendering of Board as Evaluated in a Press Simulator." EUCEPA Conference, 1982 Budapest.

Back, Ernst L. and Olsson, Anne-Mari, "The Effect of Temperature on Gloss Calendering of Board as Evaluated in a Press Simulator." *Svensk Papperstidning* (1983), pp. R31–R41.

Brecht, W. and Muller, G., "Tests Performed with a Gloss Calendar." *TAPPI Publication,* vol. 51, No. 2, (Feb. 1968), pp. 61A–66A.

Crotogino, R. H. "Temperature-Gradient Calendering." *TAPPI Journal* (Oct. 1982), pp. 97–101.

(List continued on next page.)

*Primary Examiner*—S. Leon Bashore
*Assistant Examiner*—K. M. Hastings
*Attorney, Agent, or Firm*—R. Duke Vickrey; John W. Kane, Jr.; Francis M. DiBiase

[57] ABSTRACT

Disclosed in a process for producing gloss and smoothness on the surface of a paper web, comprising:

A. advancing a web of papermaking fibers through a nip formed by a smooth metal finishing drum and a resilient backing roll; and B. heating the drum to a temperature at least high enough to heat a substrata portion of the web to a temperature in which gloss and smoothness rapidly increase with increasing temperature due to thermoplastic molding of the substrata beneath the surface and at a temperature higher than where substantial gloss and smoothness would have already been obtained by molding of the surface of the web.

17 Claims, 8 Drawing Sheets

OTHER PUBLICATIONS

Crotogino, R. H. "Temperature-Gradient Calendering." *Publication of Pulp and Paper Research Institute of Canada* (Aug. 1981), p. 327.

Deeg, Rudi F., "What Can be Gained From Controlled Heat in Supercalendering." *TAPPI Publication,* vol. 64, No. 10 (Oct. 1981), pp. 51-54.

DeMontmorency, W. H., "The Calendering of Newsprint: A Laboratory Study of Temperature and Pressure Effects." *Publication of the Pulp and Paper Research Institute of Canada* (Jul., 1967), pp. T326-T345.

Haven, E. A., "Thermoplanishing—By Design and Method." *Pulp & Paper Journal* (Jun. 10, 1968), pp. 32-33.

Hunger, Dr. Gunther K., "The Influence of Pressure, Heat and Moisture on the Finishing of Paper and Board." *Symposium on Calendering and Supercalendering of Paper,* Publication of the University of Manchester Institute of Science & Technology (Sep. 1975).

Ichinose, Lee Y., "On-Machine Soft Calendering: A Good Idea Whose Time Has Come?" *PIMA Magazine* (Dec. 1984), pp. 35-40.

Jackson, Michael and Gavelin, Gunnar, "The Role of Nip Temperature and Surface Moisture in the Calendering and Supercalendering Process." *Svensk Papperstidning* (Mar. 15, 1966), pp. 131-138, NR5.

Kerekes, R. J. and Pye, I. T., "Newsprint Calendering: An Experimental Comparison of Temperature and Loading Effects." *Pulp & Paper Canada,* vol. 75, No. 11 (Nov., 1974), pp. 65-72.

Kroeschell, W. O., "Recent Advances in the High--Temperature Finishing of Paperboard." *TAPPI Publication,* vol. 46, No. 11, (Nov. 1963), pp. 170A-172A.

Lyne, Bruce, "Machine-Calendering: Implications for Surface Structure and Printing Properties." *TAPPI Publication, vol. 59, No. 8 (Aug., 1976), pp. 101-105.*

Muench, Erhardt and Schmitz, Wimmar, "The Modern Supercalender the Basis of New Concepts for Soft Calendering." EUCEPA Conference, Budapest (Oct. 1982).

Munch, Erhardt E. A., "Application of Hot Water Heated Supercalendar-The Way to the Flexitherm-System." 1966 Annual Meeting CPPA, Montreal, pp. A159-A163.

Munch, Erhardt E.; Schlunke, Jurgen and Schmitz, Wimmar, "Supercalendering: Analyzing Effects of Hot Calendering on the Printability of Coated Papers." *Paper Trade Journal (Oct. 15, 1979).*

Schmidlin, H. L., "Rubber Roll Hardness-Another Look." *Pulp and Paper Magazine (Mar. 18, 1968), pp. 30-32.*

Schmidt, S. and Kirbis, R., "The Effects of Temperature on the Surface Levelling of Paper." *Paper Magazine (Aug. 1980), Paper 4.*

METHOD OF FINISHING PAPER UTILIZING SUBSTRATA THERMAL MOLDING

This application is a continuation of application Ser. No. 611,766, filed May 18, 1984 (now U.S. Pat. No. 4,624,794).

TECHNICAL FIELD

This invention relates generally to the manufacture of paper and in particular to a novel method of finishing printing paper in a manner which improves its properties.

BACKGROUND ART

High quality printing paper must have a number of physical properties. Two of the most important are a flat and smooth surface to facilitate printing in a press and gloss to produce a more attractive surface, particularly after printing. These properties can be obtained by a variety of techniques, such as coating the paper with pigments and binder and finishing it in one or more pressing operations.

One of the most common finishing operations employed in the manufacture of printing paper is supercalendering, in which paper is passed through a series of nips formed by steel rolls pressed against cotton filled rolls at very high pressures, typically at nip loads between 175 KN/M and 437.5 KN/M (1000 and 2500 pounds per lineal inch). This typically results in nip pressures of 13,780 KN/M$^2$ to 27,560 KN/M$^2$ (2000 to 4000 p.s.i.).

Traditional supercalender stacks are not externally heated, but heat is generated when the cotton filled rolls subjected to the extremely high pressures in the nip flex intermittently with each revolution. The nip temperatures in such supercalenders typically reach levels of about 71° C. (160° F.). Another important element in producing good results is having a high moisture content in the paper as it passes through the supercalender. Typically, the moisture content will be 7% to 9%, or higher, of the bone dry fiber weight. Flatness, smoothness and high gloss are obtained in supercalenders because of extreme compression and densification of the sheet. The densification undesirably results in reduced opacity and a blackening effect in overly moist portions.

Supercalenders commonly consist of a large number of rolls (9 to 14), alternating steel and resilient, in order to obtain the desired smoothness and gloss. In order to obtain smoothness on both sides it is necessary to run an even number of rolls and with two resilient rolls (so called "cushion rolls") running together midway in the stack to perform the necessary reversing of the side toward the steel rolls. This action is only partly successful at providing two smooth sides since the first side finished towards the steel is later deformed by the exposure to the resilient rolls.

Because of this shortcoming and the inherent mechanical problem associated with the "cushion roll" nip, many supercalenders operate today with an uneven number of nips and no "cushion roll" nip, which results in only one side being finished against the steel, and while gloss values may be manipulated to be close on the two sides, inevitably one side is noticeably rougher than the other, Another form of finishing is machine calendering wherein the paper web is passed between two normally unheated steel rolls pressed together at high pressures.

This process produces smoothness, but little gloss because of the absence of shear in the nip.

Another common finishing operation is gloss calendering, which uses heated finishing rolls to produce high gloss finishes on coated paper or board without the high pressure of supercalendering. The nip pressures for commercial machines are typically between about 87.5 to 175 KN/M (500 to 1000 pounds per lineal inch) of nip loading. This typically results in nip pressures of 6,890 KN/M$^2$ to 13,780 KN/M$^2$ (1000 to 2000 p.s.i.). The lower pressure causes less densification of the paper, and therefore, better opacity, while the higher temperature softens the coating and permits better gloss enhancement. However, the finishing effect is limited to the coating and the uppermost surface of the web. Thus, the surface of the sheet is not as smooth and flat as that produced in supercalendering and has generally been applied to coated board rather than high quality papers. As a result, gloss calendered sheets do not print as satisfactorily in a printing press as do supercalendered sheets.

In recent years, many modifications have been made to gloss calendering, machine calendering and supercalendering operations. Some supercalenders have been heated, primarily to improve the uniformity and control of the temperature. Typically, heated supercalenders reach nip temperatures of about 82° C. (180° F.). Temperatures of some machine calenders or supercalenders have been further increased in an attempt to allow a decrease in pressure to produce the same results. In spite of this modification of supercalendering in the direction of gloss calendering, the fundamental effects of the two processes have remained distinct. Supercalendering uniformly compacts the entire sheet to a high degree, thus flattening the surface fibers and all others, as well as producing gloss on the surface. In contrast, gloss calendering molds, flattens, and glosses the surface of the coating and, in the case of uncoated paper the top surface of the fibrous substrate, but compacts the remainder of the sheet much less than supercalendering.

Examples of gloss calendering are disclosed in U.S. Pat. Nos. 3,124,504; 3,124,480; 3,124,481; 3,190,212; and 3,254,593. These patents collectively describe apparatus capable of nip temperatures from below the boiling point of water to as high as 232° C. (450° F.) and nip pressures from 1,722 to 17,220 KN/M$^2$ (250 to 2500 p.s.i.). U.S. Pat. No. 3,124,480 describes finishing steps designed to heat the coating on paper to a temperature which temporarily plasticizes at least the surface of the coating in contact with the hot drum. A form of supercalendering in which the rolls are heated to relatively high temperatures is disclosed in U.S. Pat. Nos. 3,442,685 and 3,451,331. These patents disclose a method and apparatus capable of producing high gloss on coated paper by heating at least one roll of a supercalender stack to a temperature between 82° C. and 163° C. (180° F. and 325° F.) to plasticize the coating.

The one parameter which has been found to be the most critical in gloss calendering and supercalendering has been the moisture content of the paper. High moisture improves the smoothing and glossing effects of both the coating and the paper substrate. Many developments in supercalendering and gloss calendering involve techniques for increasing the moisture in the web or at least in some portions of it before finishing.

Unfortunately, moisture is an undesirable control parameter. Small variations in moisture cause large variations in the finished properties of the paper. Also, it is undesirable to have more than about 3.5% to about 4.5% moisture in the finished sheet to avoid uneven reel building and sheet curl from later drying. This amount of moisture is a stable amount, and the sheet will not dry significantly below this level under ambient conditions. To have a finished product with the desired low moisture content and still have the desired high moisture content (e.g. 7% to 9%) to facilitate calendering, many heated calendering operations have increased the drum temperature to dry the moister webs.

Nonuniformity of moisture in the sheet can be even a bigger problem than too much moisture. By nonuniformity, it is meant that the moisture content at one place on the sheet is higher or lower than at other locations across the width of the sheet. The nonuniformity can also exist in the machine direction and the thickness of the sheet. Nonuniformity is most severe when calendering takes place immediately after coating, which is to say when the calender is in line with the coater. If coating is done in a separate operation from calendering, the moisture content of the coated paper has time to equalize throughout the web before calendering.

The above cited U.S. Pat. No. 3,124,504 is primarily concerned with very moist webs (up to 35% or 50% moisture) and includes the concept of drying the web while finishing it. Very high temperatures are employed for drying, but temperature above the boiling point of water are said to be needed only if the web is wetter than 5% to 8% of the bone dry weight. The web moisture content is also noted as being an important element in the process disclosed in above cited U.S. Pat. Nos. 3,442,685 and 3,451,331. The patents teach that it is best for the paper to have about 7% moisture content, and moisture can be added before the supercalender to improve the finishing effects. The addition of moisture before finishing is also described in above cited U.S. Pat. No. 3,124,482 to manufacture glazed uncoated paper. U.S. Pat. No. 2,214,641 also moistens the surface of the web before finishing. In U.S. Pat. No. 4,012,543, gloss calendering is undertaken immediately after coating before too much of the moisture is lost from the coating. In this disclosure, finishing is carried out at a web moisture content of 9% to 10% of the bone dry weight. In contrast, U.S. Pat. No. 3,268,354, takes special steps to dry the surface of the coating, but to maintain a wet interface between the coating and the fibrous web before gloss calendering. The web in this disclosure has a moisture content of at least 15% at the interface.

DISCLOSURE OF THE INVENTION

The present invention is a new process which permits the manufacture of paper with supercalender smoothness and gloss without the above noted disadvantages of supercalendering.

The invention is a process for producing gloss and smoothness on the surface of a paper web, comprising:

A. advancing a web of papermaking fibers through a nip formed by a smooth metal finishing drum and a resilient backing roll; and B. heating the drum to a temperature at least high enough to heat a substrata portion of the web to a temperature in which gloss and smoothness rapidly increase with increasing temperature due to thermoplastic molding of the substrata beneath the surface and at a temperature higher than where substantial gloss and smoothness would have already been obtained by molding of the surface of the web.

The invention is also a process for producing gloss and smoothness on the surface of a paper web, comprising the steps of:

A. providing a finishing apparatus comprising a smooth metal finishing drum and a resilient backing roll pressed against the drum at a force of between 35 and 700 KN/M (200 and 4000 pounds per lineal inch) to form a nip;

B. advancing a web of papermaking fibers having a moisture content in the fibers of from 3% to 7% of the bone dry weight of the fibers through the nip at a speed which results in the web dwelling in the nip from 0.3 milliseconds to 12 milliseconds; and C. simultaneously with step B, heating the drum to a surface temperature having a value no less than 40° C. below the value determined by the following formula:

$$Ts=[Ti\times 0.357t^{-0.479}-234\cdot 2e^{-0.131m}]/[0.357t^{-0.479}-1]$$

where:

Ts=surface temperature of the heated drum, in °C.;

Ti=the initial temperature of the web just prior to entering the nip, in °C.;

t=dwell time of the web in the nip, in milliseconds;

e=the base of the natural logarithm; and m=moisture content of the fibers in the web in weight percent of the bone dry fiber weight.

Much of the prior art discloses broad operating conditions in which some of the conditions of the present invention fall, but fail to teach the special requirements for low moisture paper and are far too broad in their disclosures for one to appreciate the present critical operating range. They all either calender at a temperature below the present invention, calender the web too wet, or teach a very broad temperature range which might accidentally include the present range.

The invention is believed to owe its success to one phenomenon believed to be unappreciated before this invention and to another phenomenon just beginning to be appreciated. With respect to the first, it has been discovered that an unexpected increment of gloss and smoothness can be obtained in a critical temperature range. With respect to the second, cellulosic fibers, such as papermaking fibers, appear to exhibit thermoplastic properties and in particular appear to have a glass transition temperature ("Tg") above which the fibers become much more flexible and moldable when subjected to pressing forces. The Tg of cellulose in paper is greatly dependent upon the moisture content of the paper and is very low for papers as moist as those traditionally supercalendered. However, this very property which facilitates supercalendering also results in the undesirable ultra sensitivity to moisture variations and the undersirable ultra densification through the entire thickness of the web.

Although some of the prior art relating to gloss calendering recognized the effects of temperature on moldability of the coating and the surface fibers of uncoated paper, none recognized the existence of a critical strata beneath the surface of the fibers which must be molded flat to obtain the flatness and smoothness of supercalendering.

The invention, which can be described as substrata thermal molding, is based upon molding the critical substrata of the web into a flat strata permitting the surface of the fibrous web and any coating to be flattened, smoothed and glossed to the degree obtainable by supercalendering. This strata is the foundation for the surface, and molding below this level is not critical to obtaining supercalender flatness. Thus the molding of the entire thickness of the sheet as in supercalendering is unnecessary, provides little advantage, and results in the previously noted disadvantages.

The present invention does not require a web as moist as those generally subjected to supercalendering and gloss calendering. The present invention performs satisfactorily on a web having a moisture content less than 7% of the bone dry weight of the fibers and even less than 6% or 5%. Surprisingly, the invention works satisfactorily at even lower moisture contents, even as low as 3%. Consequently, finished products can be easily produced at desirable moisture levels without having to dry them in the finishing process. In addition, the ability to finish the web at lower moisture contents permits drying down the web immediately before finishing to a low level where moisture content is substantially uniform throughout the web, preferably with no variation greater than 0.5% from the average. Thus, the invention is particularly valuable where coating and finishing are done continuously in line with each other. It is even more valuable when coating and finishing are done continuously in line with the papermaking machine.

The principal shortcoming of the prior art hot calendering of coated paper was that it only molded the coating with little effect on the fibrous substrate. Consequently, while high gloss could be obtained, the very flat smooth surface of supercalendering was not obtainable. With uncoated paper, the prior art molded only the surface fibers to coalesce or seal the surface of the sheet. The effect needed to reach the critical substrate, which is believed necessary to flatten the web, was not appreciated. Adding confusion to these teachings was a failure to understand the role of moisture and temperature in molding the sheet. For example, much of the prior art teaches that temperatures below the scope of the present invention will suffice at low moisture, but higher temperatures are needed at higher moistures to dry the sheet.

In a preferred embodiment of the present invention, the finishing apparatus includes a second resilient backing roll pressed against the drum preferbly within the same pressure range as the first to form a second nip. The web is advanced through the second nip after the first nip within a short period of time, less than 4 seconds, to provide a great advantage, uniquely valuable to this invention and explained as follows. The key to the invention is to heat a critical substrate of the web to its Tg. Obviously, this requires a drum surface temperature hotter than the Tg. At the same time, the Tg increases with reduction in moisture. Thus, conflicting goals exist in selecting the drum temperature. If the temperature is too low, the heating time required, which is limited to dwell time in the nip, will be too long and cause too much loss in web moisture, as well as a tendency to raise the temperature of the entire web to the same temperature. If the temperature is too high, the web must be sped through the nip too fast to provide the dwell time needed as well as perhaps being beyond commercially feasible machine speeds.

As set forth in the above description of the invention, there is a drum temperature range wherein the invention works satisfactorily. However, the use of two nips on one drum will permit the drum temperature to be lower and the invention to work more satisfactorily. The web is heated quickly in the first nip to a relatively high temperature on its surface which is in contact with the drum, but the temperature on the opposite side will increase little, if any. Immediately upon leaving the first nip, the temperature of the web through its thickness tends to equalize, while of course losing some heat to the air from both surfaces. As a result, the entire web, and most importantly the critical substrata, has a temperature raised above its previous temperature, but below its Tg, when it enters the second nip. In the second nip the same type of temperature gradient that existed in the first nip is established, but with the interior temperature of the web higher than before. Thus, the critical portion of the web can be brought to the critical temperature using a lower drum temperature or faster process speed than needed with only a single nip. Of course, the additional pressing time provided by two nips will result in surface improvements also.

In the preferred form of the invention, the web will be passed through the nip or nips without contacting the heated drum except in the nips for the reasons stated above. However, there may be cases where it is desirable and not too disadvantageous to have some additional drum contact. In those cases, it will be preferable to limit the contact to less than 20% of the drum circumference.

BEST MODE FOR CARRYING OUT THE INVENTION

The following definitions are provided to better understand these terms in this specification and claims.

Parker Print-Surf— a quantitative measurement commonly used in the papermaking field for the printing roughness and porosity of paper made by sensing the leakage of air at low pressure between the surface of the sample and the measuring sensing head. The lower the value, the smoother the paper. Parker Print-Surf can be measured with several different pressures of the dam against the paper being measured. In the present specification and claims, all were measured with a pressure of 10 $Kg/cm^2$. Supercalendered coated woodfree paper will typically have a Parker Print-Surf of less than 1.4 and less than 1.0 for very high quality. Gloss calendered coated woodfree paper will typically have a Parker Print-Surf of between 1.2 and 2.0.

75% Hunter Gloss—a well-recognized quantitative measurement of the amount of light specularly reflected at an angle 75° from a line at a right angle to the plane of the paper. Glossy grades of coated papers typically have a gloss of from 50 to 90. Above 70 is considered as very high gloss.

Figure 1:
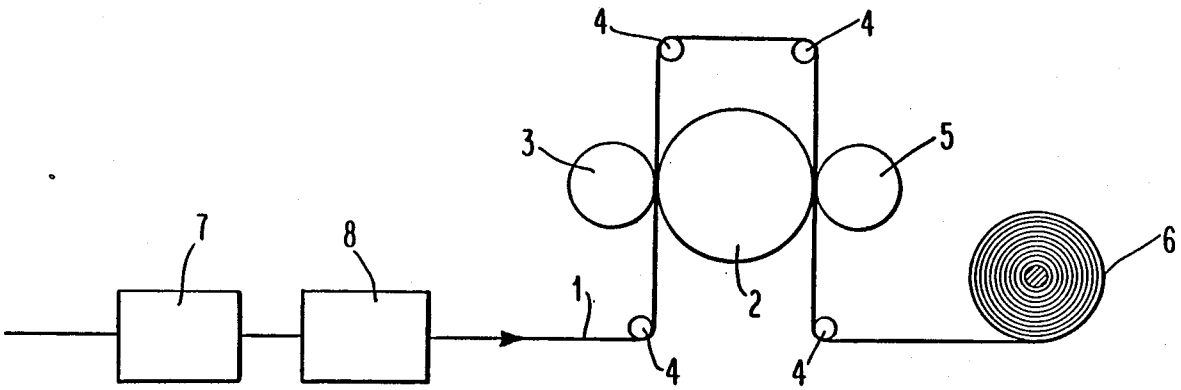
FIG. 1 illustrates schematically an apparatus suitable for practicing the present invention.

The present invention can be carried out on an apparatus like that illustrated in FIG. 1. A paper web 1 is advanced through the first nip formed by smooth surface finishing drum 2 and resilient backing roll 3, around guide rolls 4, and through a second nip formed by drum 2 and a second resilient backing roll 5 pressed against drum 2. Thereafter, if desired for finishing the other side of the web, the web 1 is advanced to a second smooth surface finishing drum with a pair of nips formed by resilient backing rolls similar to the first unit (not illustrated for simplicity). The finished web is then wound onto reel 6. Variations in the process can be carried out by omitting or bypassing the second nip on each drum and/or finishing on one side only, in which case the second drum is bypassed or omitted.

The web 1 supplied to the finishing apparatus can come directly from a papermaking machine 7 and/or coater 8, if the paper is to be coated. In the alternative, the web 1 can be supplied from a roll of previously manufactured paper which may or may not have already been coated. The papermaking machine and coater are illustrated only as blocks since they can be provided by any conventional apparatus well known in the art.

The finishing apparatus employed in the invention can be provided by any of the many disclosed in the previously described prior art relating to gloss calendering if they are designed or can be adapted to operate at the temperature, pressure and speed conditions of the invention. Accordingly, little description of the apparatus will be given herein except to emphasize the importance of choosing a finishing drum which can be heated to the temperatures required by the invention and has a smooth metal surface and choosing a resilient backing roll which is yieldable but will have sufficient hardness at operating temperatures to provide a nip force between 35 and 700 KN/M (200 and 400 pounds per lineal inch) of nip, which could require pressures as high as 60,000 KN/M$^2$ (8,700 p.s.i.) at the extreme end of the range. The actual pressure to which the paper web is subjected in the nip will depend upon the force applied and the width of the nip. Resilient backing rolls flatten somewhat at the nip and will preferably have a nip width of from 1.27 to 2.54 cm (0.5 inch to 1.00 inch) for the present invention. Nip widths shorter than 1.27 cm and longer than 2.54 cm could be usable with the invention. However, widths shorter than about 0.635 cm will likely require undesirably slow machine speeds and nip widths wider than 2.54 cm will likely require backing rolls of undesirably large diameter and/or softness If is preferable for the backing roll surface to have a P.&J. hardness of about 4 or harder at operating temperatures to develop the desired nip width and pressure. To maintain this hardness may require internal cooling of the roll, since the typical resilient roll materials become soft very quickly at elevated temperatures. An example of a roll which can perform satisfactorily in the invention is disclosed in U.S. Pat. No. 3,617,445.

The following examples illustrate the invention.

EXAMPLE 1

An uncoated and uncalendered bodystock of a mixture of Northern hardwood and softwood fibers produced in a Kraft pulping process was unwound from a roll and passed through an apparatus similar to that illustrated in FIG. 1. The web had been mineral filled and sized to have 10% ash content by weight, and the web weighed 93.3 g/m$^2$ (63 pounds per ream of 3300 ft$^2$). The finishing apparatus was operated with only one nip at a force of 175 KN/M (1000 pounds per lineal inch) and a nip width of 0.47 cm (0.185 in). The temperature of the web was about 26.7° C. (80° F.) just before entering the nip. The moisture content of the web was measured to be 4.8% of the bone dry weight of the fibers.

The web was passed through the finishing apparatus at 1.02 m/s (200 feet/min), resulting in a dwell time in the nip of 4.5 milliseconds. The temperature of the drum was adjusted throughout the test from a surface temperature of 82.2° C. (180° F.) to 171.1° C. (340° F.), and samples of the finished product were taken at various intervals. The samples were tested for 75° Hunter gloss values and Parker Print-Surf values, which were plotted against drum surface temperature in FIG. 2.

EXAMPLE 2

A bodystock like that of Example 1 was coated on one side with a conventional pigment binder coating having a weight of 14.8 g/m$^2$ (10 pounds per ream of 3300 ft$^2$), dried and passed through the same apparatus and same procedure as Example 1, except the finishing drum surface temperature was adjusted from 25.6° C. (78° F.) to 190.6° C. (375° F.). The coater was in line with the finishing apparatus. The moisture content of the coated web was about 3.9% of the bone dry weight of fibers. The temperature of the web was about 48.9° C. (120° F.) just before entering the nip. Samples were taken for different temperature intervals and tested for 75° Hunter gloss values and Parker Print-Surf values, which were plotted against drum surface temperature in FIG. 3.

Because the data was a little scattered due to the small number of readings taken on each sample involved, a ratio between gloss and Parker Print-Surf was determined (which was constant) and an on-machine produced gloss curve (which measured a large number of samples) was used to produce the gloss curve and to determine the proper curve within the Parker Print-Surf points.

EXAMPLE 3

A bodystock like that of Examples 1 and 2 was coated on both sides with coatings of the same type and amount as in Example 2 and passed through a finishing apparatus in line with the coater and similar to that employed for Examples 1 and 2, but with two finishing drums. Each of the drums had two resilient backing rolls forming a pair of nips. One side of the paper was finished against one drum and the other side against the other drum. The nip pressure for the first drum was varied during the test from 263 KN/M (1500 pounds per lineal inch) to 333 KN/M (1900 pounds per lineal inch). The nip pressure on the second drum was held at 333 KN/M (1900 pounds per lineal inch) and its drum surface temperature at 162.8° C. (325° F.) throughout the test. One of the resilient backing rolls on the first drum was removed during part of the test. The moisture content of the web was about 4.7% just prior to the first drum and about 0.5% less at the second drum. (The decrease was due to evaporation of moisture from the heated web surface between drums.) The web was passed through the nips at 8.89 m/s (1750 feet per minute). The nip widths were about 2.21 cm (0.87 in), resulting in a nip dwell time of about 1.5 milliseconds. The temperature of the web was about 71.1° C. (160° F.) just before entering the first nip. Samples of the product produced were taken at the following conditions for the first side and first finishing drum.

| Sample No. | No. of Nips | Pressure | Temperature |
|---|---|---|---|
| 1 | 2 | 333 | 121° C. |
| 2 | 2 | 333 | 147.8° C. |
| 3 | 2 | 263 | 147.8° C. |
| 4 | 1 | 263 | 147.8° C. |
| 5 | 1 | 263 | 135° C. |
| 6 | 1 | 263 | 121° C. |
| 7 | 2 | 263 | 121° C. |

Figure 4:
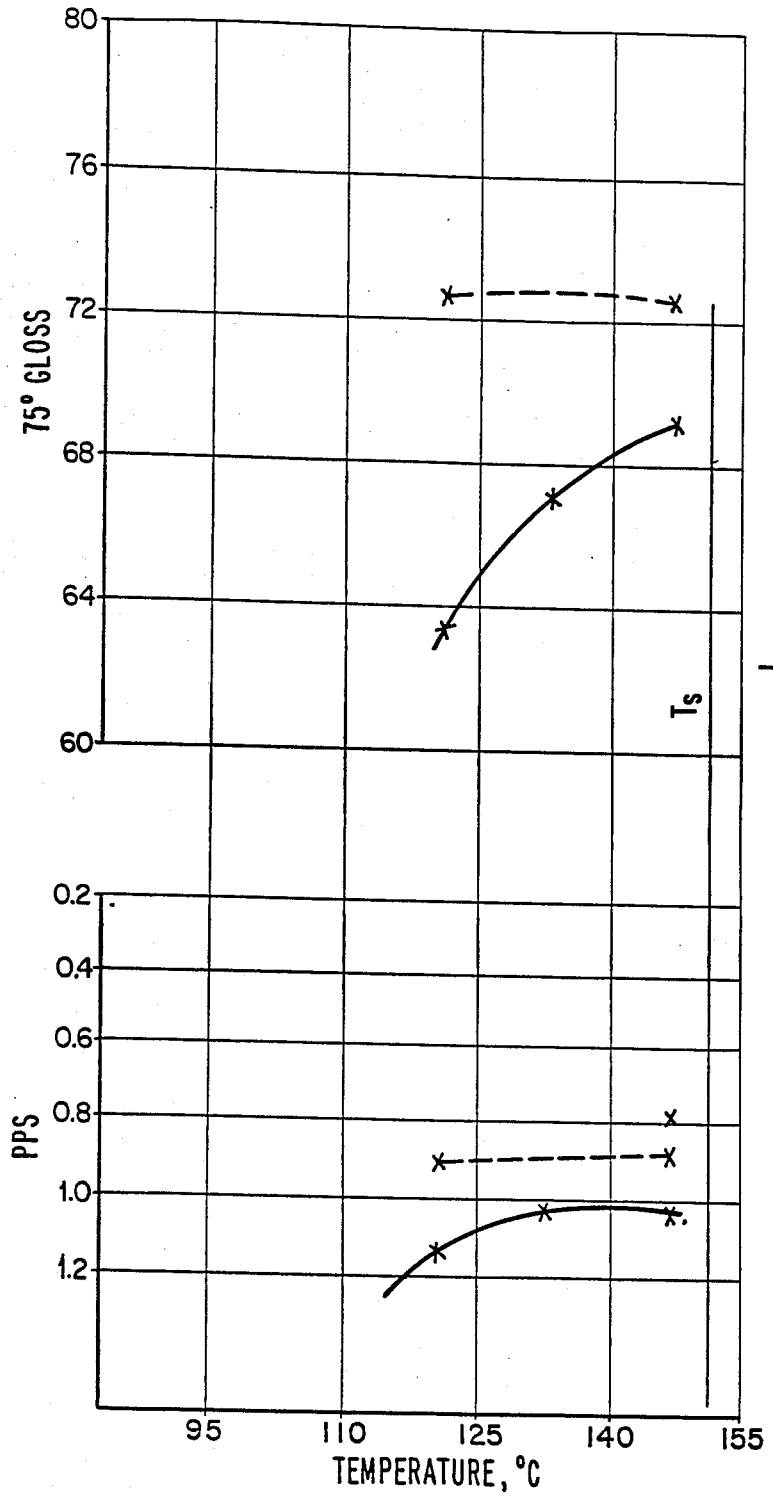
FIG. 4 is a graph illustrating the gloss and smoothness values for the coated paper finished at various temperatures in Example 3.

The samples were tested on the first side for 75° Hunter gloss and Parker Print-Surf values, which were plotted against temperature in FIG. 4. The gloss values for the second side on the same samples were very constant (71.7, 72.5, 71.9, 71.5, 71.6, 71.7, 71.8), as were the values for Parker Print-Surf (0.95, 0.95, 0.97, 0.995, 0.96, 0.95, 0.88). This shows the ability to control the surface properties of one side independently from those of the other, in contrast to supercalendering. This is believed to be possible because temperature and not pressure is the predominant factor, and the high surface temperature of the drum does not transfer through the web to the other surface of the web.

Figure 2:
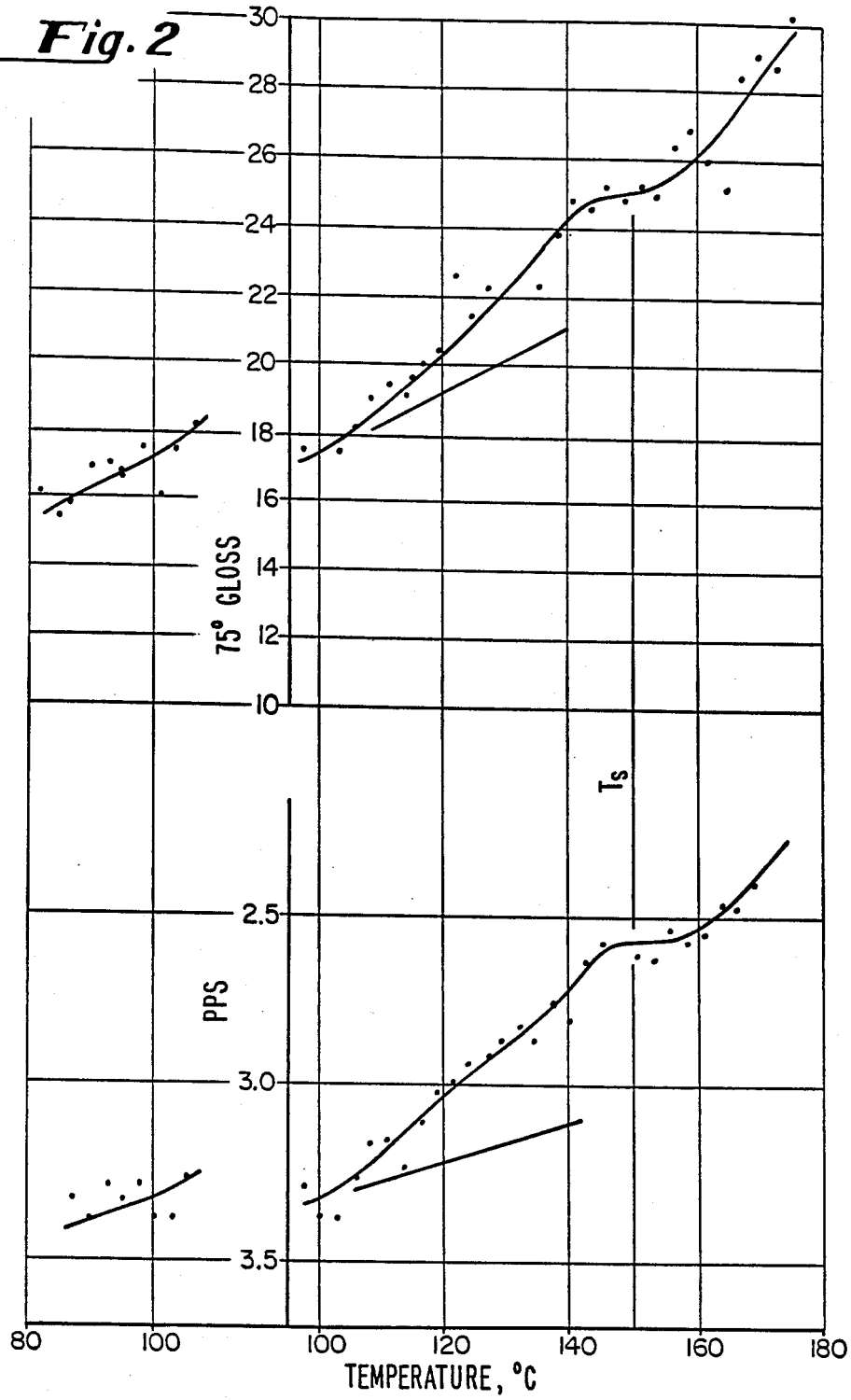
FIG. 2 is a graph illustrating the gloss and smoothness values for the uncoated paper finished at various temperatures in Example 1.

FIG. 2 is shown in two portions, the left covering temperature ranges up to about 110° C. (230° F.) and the right from about 104.4° C. (220° F.) up. On the left, one can see that gloss and Parker Print-Surf increase at a steady rate with increasing temperature up to about 104.4° C. (220° F.). This is believed to be the effects from molding and coalescing the surface of the web and is what one would expect from the prior art.

On the right side of FIG. 2 is illustrated the unexpected results of the invention. That is, at a specific temperature, about 110° C. (230° F.) in this case, there is a sudden rapid improvement in Parker Print-Surf for increasing temperatures. There is also a similar increase in gloss, and this is believed to be due to the interrelationship of flatness to gloss. This additional increment of gloss and flatness was unexpected, but once discovered is believed to be due to the portion of the web beneath the surface, or the subsurface strata, being heated to its glass transition temperature and suddenly softening and becoming moldable to allow the surface to be flattened to a greater degree than before. The advantages provided by the thermal moldability of the subsurace strata continue only up to about 148.8° C. (300° F.), after which there is no improvement in gloss or flatness for the next 16.7° C. (30° F.).

Figure 3:
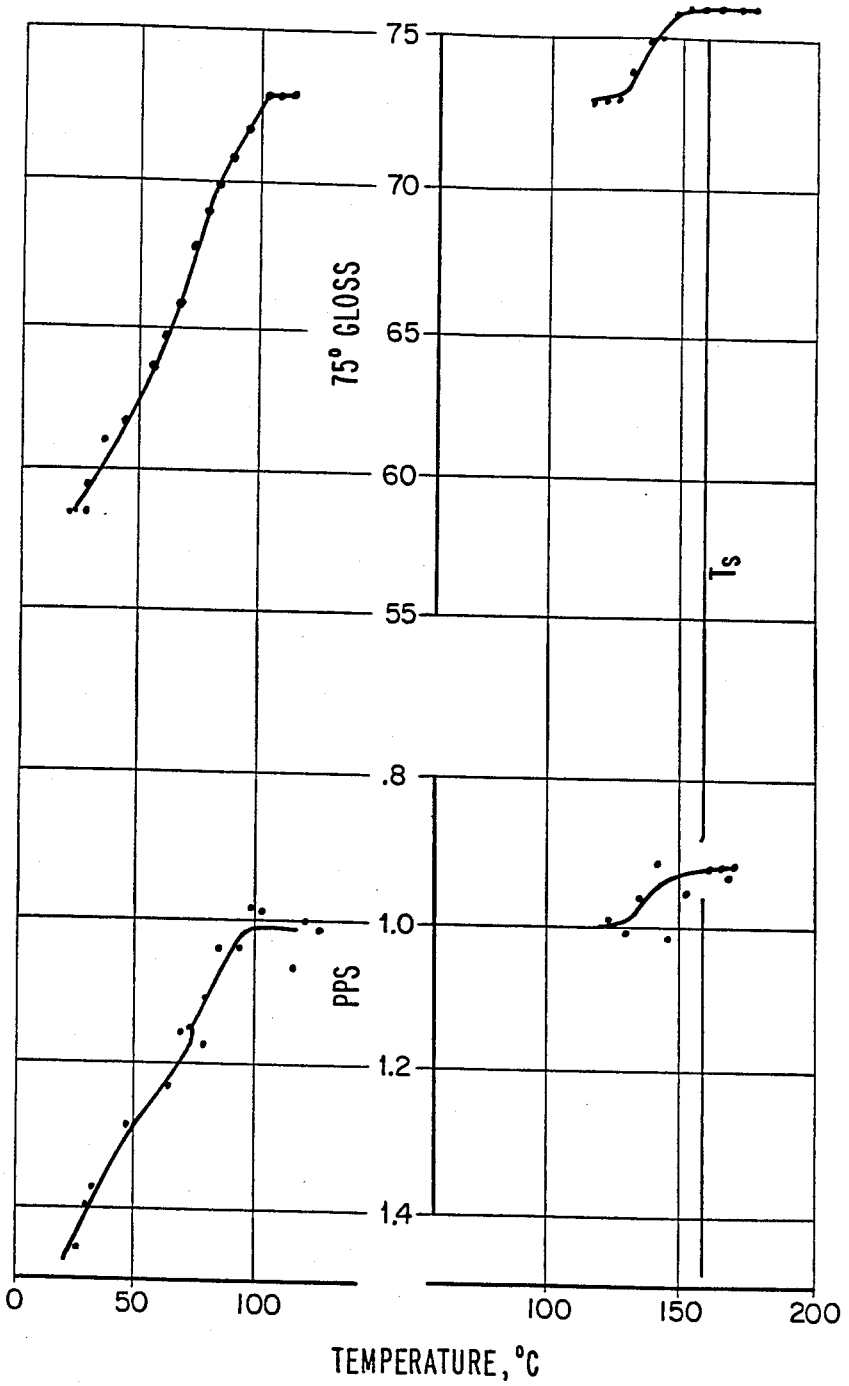
FIG. 3 is a graph illustrating the gloss and smoothness values for the coated paper finished at various temperatures in Example 2.

FIG. 3 displays a similar phenomenon to FIG. 2. On the left side one can see the Parker Print-Surf and gloss increase at a steady rate with increasing temperature up to about 93.3° C. (200° F.), after which there appears to be no further increase with increasing temperature. This flattening of the curve is believed to be due to the behavior of coating being thermally molded and is believed to be what one would expect from the prior art. This may also explain why gloss calendering, which is more temperature controlled than supercalendering, was thought to have limited ability to improve Parker Print-Surf values. On the right of FIG. 3 is illustrated the results of the invention. At about 126.7° C. (260° F.) there is a rapid improvement in gloss and flatness for the next 36.8° C. (65° F.). This result is totally unexpected.

A study was undertaken to attempt to better explain the results of the invention and to determine if the temperature at which this phenomenon occurs can be predicted for various conditions. The study starts with the belief that a substrata of the fibers in a fibrous web can be heated to the Tg of the fibers to flatten the surface of the web. The invention proves that this can be done at commercially feasible speeds and at a moisture content which is more desirable than those previously found necessary. To determine this temperature a number of factors are involved. First, the Tg must be adjusted for the dynamic conditions involved in high speed finishing (i.e., between 2.54 and 25.4 M/S or 500 and 5000 feet per minute). This means in effect that the flexibility or moldability of the fibers is not only dependent upon their temperature, but upon the rate at which they are compressed. They in effect have an apparent glass transition temperature which is based upon dynamic conditions and will be higher than the static Tg. (Unless otherwise stated, reference to "Tg" hereafter will refer to the apparent glass transition temperature at dynamic conditions.) In addition, the dynamic heat transfer conditions must be met to raise the temperature of the critical substrata of the web to its Tg while in the nip.

Moisture plays a major role in determining the Tg of the fibers, and the present invention surprisingly is capable of producing supercalender quality at much lower moisture levels than those employed in supercalendering. The same phenomenon which facilitates flattening of the critical substrata in the present invention causes the entire thickness of the web in supercalendering to be molded at a temperature above its Tg. The reason is that the high moisture content of paper employed in supercalendering, can result in a Tg low enough to be reached throughout the web by the temperature conditions of supercalendering, even when unheated.

Some moisture will be lost between nips in a multinip apparatus, due to evaporation of the moisture while travelling between nips. At the low moisture levels of this invention, that amount is about 0.25% to 0.5% per nip (e.g. from 5% to 4.75% or 4.50%). However, that amount will cause a need for a significant increase in temperature in subsequent nips. Preferably, the first drum temperature in a two drum apparatus will be set for the moisture content at the second nip. If there are two drums, the second drum temperature will preferably be higher than the first to accommodate the lower moisture content of the web resulting from heating at the first drum. Since satisfaction of any needed drum surface temperature for any one nip will provide some of the advantages of the invention, this invention includes a process wherein one or more of the nip conditions do not satisfy the temperature requirements.

Figure 5:
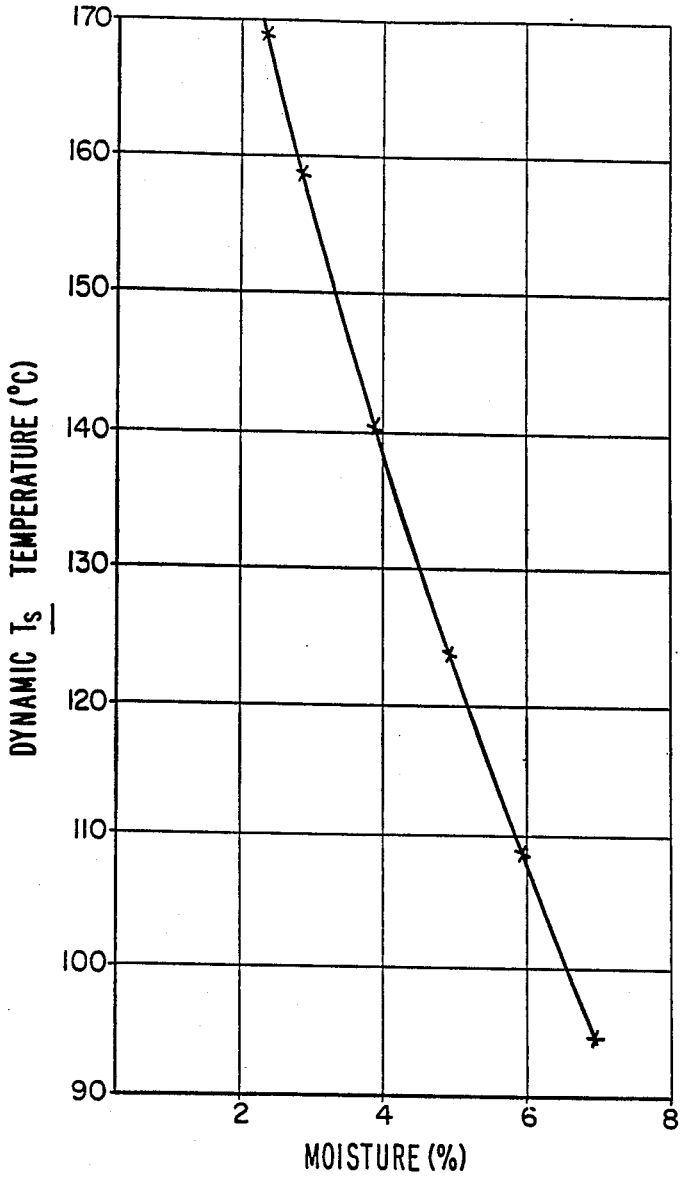
FIG. 5 is a graph showing the dynamic Tg of cellulose fibers for various moisture contents.

FIG. 5 illustrates Tg values for cellulose fibers at various moisture levels. The curve was derived from the experimental work of N. L. Salmen and E. L. Beck (The Influence of Water on the Glass Transition Temperature of Cellulose, *TAPPI Journal*, Dec. 1977. Vol. 60, No. 12) and (Glass Transitions of Wood Components Hold Implications for Molding and Pulping Processes, *TAPPI Journal*, July 1982, Vol. 65, No. 7, pp. 107–110). The curve was adjusted for the dynamic conditions in a finishing nip. That is, the Tg values have been increased over those derived by Salmen and Beck by about 12° C., since the yieldability of any polymer-like material will become less for any given temperature if the force is applied over a shorter time span. The result is that the Tg of the material appears to be higher at dynamic conditions than for static conditions. To make this adjustment, the Williams-Lande-Ferry equation was employed. The very large increase in Tg for small reductions in moisture content in the range of the invention, 3% to 7%, should be noted.

When practicing the preferred forms of this invention, the web dwells in the nip very briefly, due to short nip widths and fast operating speeds. For example consider nip widths of 0.635 to 2.54 cm (¼" to 1") and machine speeds of 2.54 to 25.4 M/S (500 to 5000) feet per minute). The web dwell time in the nip will be from 0.3 to 12 milliseconds. At these short dwell times, the heat from the drum does not penetrate very far into the web.

Figure 6:
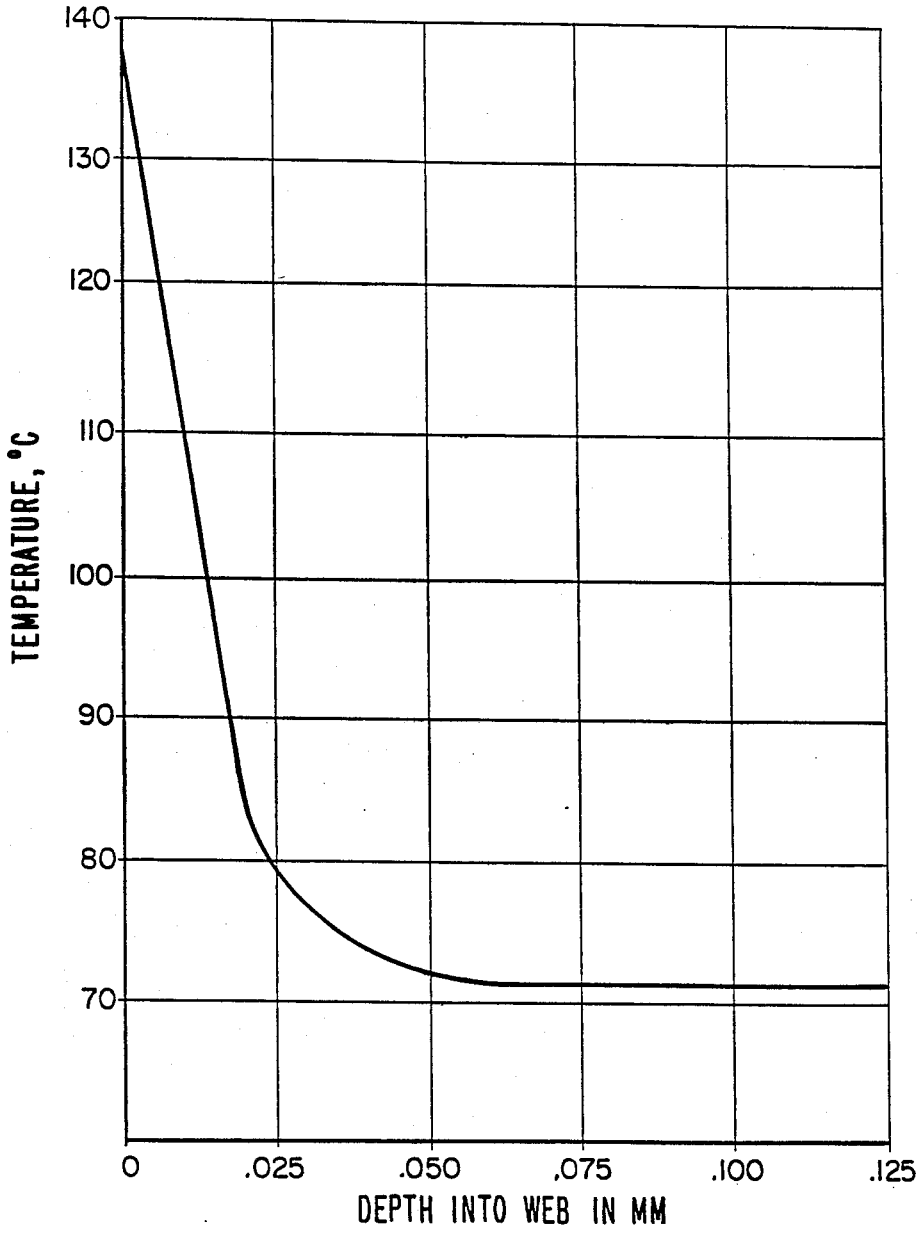
FIG. 6 illustrates schematically the temperature gradient into the thickness of the paper in a nip of the apparatus illustrated in FIG. 1.
Figure 7:
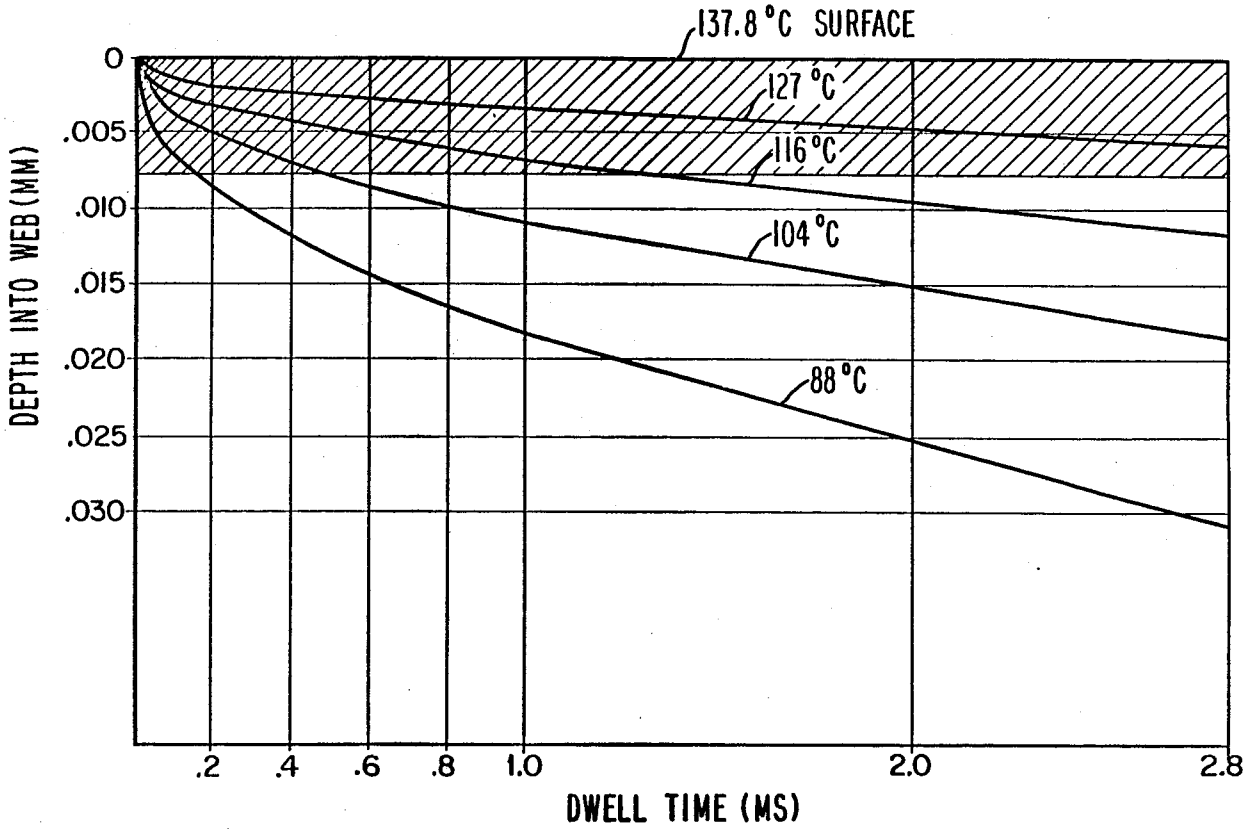
FIG. 7 is a graph showing the temperature gradient into the thickness of the web for various dwell times of the web in the nip.

FIG. 6 illustrates the temperature gradient into a web at 1.5 milliseconds of dwell time (corresponding to a nip width of 1.32 cm and a machine speed of 8.9 M/S). For this illustration, the drum surface temperature is 138° C., the web temperature prior to entering the nip is 71° C., and the backing roll surface temperature is 71° C. The temperature gradient in the web was determined by the formula:

$$\frac{T(x,t) - To}{Ti - To} = erf\frac{X}{2\sqrt{at}}$$

where:

T(x,t)=temperature in °C. at distance X into the web and at time t;

To=surface temperature in °C. of the drum;

Ti=initial temperature in °C. of the web entering the nip;

X=distance in feet into the web;

a=0.005 ft²/hr;

t=time in the nip in hrs,

FIG. 7 illustrates the temperature gradient into the thickness of the web for various nip dwell times. In this illustration the drum surface temperature is 138° C. and the paper temperature just prior to reaching the nip is 71° C. The approximate location of the critical substrate is believed to be about 0.0076 mm (0.3 mils ) deep and is illustrated by the shaded portion. It can be seen that the temperature of the critical substrata will depend upon dwell time and surface temperature. Whether or not the critical substrata temperature is as high as its Tg will depend in part upon its moisture content. Thus, for the conditions illustrated in FIG. 7, the critical temperature will be reached for moisture contents from 5% to 7.5%, depending upon the dwell time chosen.

It should be noted here that the exact location of the critical substrata is not known. The above noted location of 0.0076 mm (0.3 mils) into the web is an estimate based upon typical roughness of paper, it being necessary to heat fibers down into the valleys of the web. However, it is not critical that this assumption be correct, as will be explained later.

Figure 8:
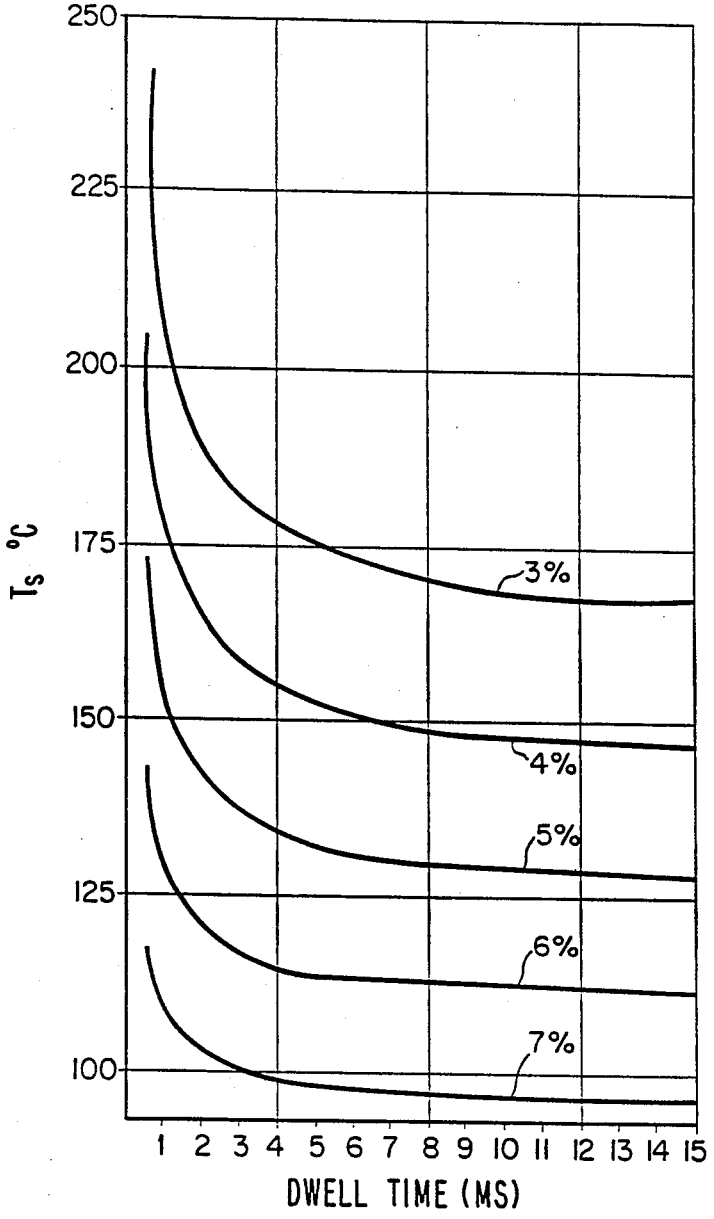
FIG. 8 is a graph showing the drum surface temperature required for the invention for various moisture contents and various dwell times.

FIG. 8, further illustrates the effects of dwell time, moisture content and surface temperature of the drum in raising the critical substrata to its Tg. The curves illustrated in FIG. 8 assume the same 0.0076 mm (0.3 mils) of depth for the critical substrata as in FIG. 7 and a web temperature of 71° C. just prior to entering the nip. This temperature is not uncommon where finishing takes place immediately after coating and drying. It is expected that the webs may be at other temperatures from ambient to about 93.3° C. (200° F.), in which case the curves would vary somewhat.

The drum surface temperature needed for a web entering the nip can be determined by the formula:

$$Ts=[Ti\times 0.357t^{-0.479}-Tg]/[0.357t^{-0.479}-1]$$

where:

Ts=surface temperature of the heated drum, in °C.;

Ti=the initial temperature of the paper entering the nip, in °C.;

t=dwell time of the web in the nip, in milliseconds;

Tg=the dynamic glass transition temperature of the web at the moisture conditions existing in the nip, in °C.

The Tg can be determined from the curve in FIG. 5. A formula which very closely approximates that curve is the following:

$$Tg=234.2\times e^{-0.131m}$$

where:

Tg=glass transition temperature under the dynamic and moisture conditions existing in the nip in °C.;

e=the base of the natural logarithm;

m=moisture content of the fibers in web in % of the bone dry weight of the fibers.

The following is a guide for determining the drum surface temperature Ts, in °C. required for the present invention for various moisture contents, initial web temperatures and dwell times.

| Dwell | Moisture Content | | | | |
|---|---|---|---|---|---|
| Time (ms) | 7% | 6% | 5% | 4% | 3% |
| | Ti = 26.7 ° C. (80° F.) | | | | |
| .5 | 160 | 187.2 | 217.2 | 251 | 288.9 |
| 1.0 | 132.2 | 153.3 | 177.5 | 204.2 | 233.9 |
| 2.5 | 114.3 | 132.2 | 152.1 | 174.2 | 198.9 |
| 5 | 107.1 | 123.6 | 141.8 | 162.2 | 184.9 |
| 10 | 102.7 | 118.1 | 135.4 | 154.7 | 176.2 |
| 15 | 100.8 | 116 | 132.8 | 151.6 | 172.6 |
| | Ti = 48.9° C. (120° F.) | | | | |
| .5 | 137.9 | 165.1 | 195.6 | 229.1 | 266.7 |
| 1.0 | 119.3 | 140.8 | 164.8 | 191.7 | 221.1 |
| 2.5 | 107.4 | 125.3 | 145.2 | 167.4 | 192.1 |
| 5 | 102.7 | 119.1 | 137.4 | 157.7 | 180.4 |
| 10 | 99.7 | 115.2 | 132.4 | 151.7 | 173.2 |
| 15 | 98.4 | 113.6 | 130.4 | 149.2 | 170.2 |
| | Ti = 71.1° C. (160° F.) | | | | |
| .5 | 115.5 | 142.8 | 172.8 | 206.1 | 243.3 |
| 1.0 | 106.7 | 127.8 | 152.2 | 178.3 | 208.3 |
| 2.5 | 100.6 | 118.3 | 138.2 | 160.3 | 185 |
| 5 | 98.2 | 114.6 | 132.8 | 153.3 | 176.1 |
| 10 | 96.7 | 112.1 | 129.4 | 148.9 | 170 |
| 15 | 96.1 | 111.1 | 128.1 | 146.7 | 167.8 |
| | Ti = 93.3° C. (200° F.) | | | | |
| .5 | 93.9 | 121.1 | 151.4 | 185.1 | 222.8 |
| 1.0 | 93.8 | 115.3 | 139.2 | 165.9 | 195.6 |
| 2.5 | 93.7 | 111.6 | 131.5 | 153.7 | 178.3 |
| 5 | 93.7 | 110.1 | 128.4 | 148.8 | 171.4 |
| 10 | 93.65 | 109.2 | 126.4 | 145.7 | 167.1 |
| 15 | 93.64 | 108.8 | 125.7 | 144.4 | 165.3 |

Based upon the above formula developed, a needed drum surface temperature (Ts) can be determined for each of the Examples. For Example 1, where moisture content was 4.8%, nip dwell time was 4.5 milliseconds, and the initial web temperature was about 26.7° C., the Ts value is about 147.8° C. (298° F.). Looking at FIG. 2, this value, illustrated by the faint line, can be seen to be at the top of the temperature range where the unexpected rise in gloss and flatness occur. The advantages of the invention actually begin about 40° C. (70° F.) lower.

For Example 2, where moisture content was about 3.9%, nip dwell time was 4.5 milliseconds, and initial web temperature was about 48.9° C. (120° F.), the Ts value is about 161.7° C. (323° F.). Looking at FIG. 3, this value, illustrated by the faint line, can be seen to be at the top of the temperature range where the unexpected rise in gloss and flatness occur also. The advantages of the invention actually begin about 40° C. (70° F.) lower. This is considered good correlation with the results for FIG. 2.

Example 3 produced too little data to produce the full curves of the other examples, but the temperature settings in that test were chosen in accordance with the above formula with the intent to show the inflection of gloss and flatness near the unexpected rise. Moisture content of 4.7%, nip dwell times of 1.5 milliseconds, and initial web temperature of 71.1° C. (160° F.) result in a calculated Ts value of about 153.9° C. (309° F.). FIG. 4 shows by the faint line where this point is located on the gloss and flatness curves. This part of the curve appears to correspond to the end of the unexpected rise, this being consistent with the results from Examples 1 and 2 and the formula.

There are components involved in the formula which can only be estimated. The location of the critical substrata is one already identified. Another is the exact value of the nip dwell time. The formula assumes that heating of the web occurs through the entire nip, but the greatest molding pressure only occurs in the center of the nip. Thus, the temperature reached upon exiting the nip is not as meaningful as that reached at some point between the center and the end. Determining what portion of the nip that should be used in the formula is difficult and not necessary. Also, the meaning of reaching the Tg of the fibers needs further explanation. The softening of polymeric materials is a second order transition and occurs over a range of temperature rather than sharply as in a first order transition, such as in the melting of ice. The breadth of the range is also a function of the molecular weight distribution with a wider distribution giving a wider range. This same softening may occur prior to reaching the temperature where the maximum effects are noted. None of these components need to be known precisely to develop a useful formula, because the formula need only be compared to the test results in the examples and a correction made to determine the starting and ending point of the unexpected rise in gloss and flatness. It is not known nor important to know which component or components have been estimated incorrectly, if any. The empirically determined adjustment corrects them and provides a formula suitable for determining the invention for all conditions contemplated by the invention. The good correlation between the examples is evidence of this.

FIG. 4 also includes in dotted lines the results of samples 3 and 7 of Example 3. They are located, as expected, slightly higher due to increased pressure effect of 2 nips, but in a nonimproving relationship to each other with increase in temperature. This is believed to be for the reason stated earlier, that two nips in rapid succession are equivalent to higher drum temperature. Thus, if the solid curves were extended into higher temperatures in the manner predicted by FIG. 2, they would be flat. The single point represents the higher pressure of sample 1.

Although the benefits of the invention begin at a temperature about 40° C. below the calculated Ts, it is preferable that the drum surface be heated to no less than 20° C. below the Ts to provide about one-half of the beneficial range and even more preferable that all of it be practiced, which requires the drum to be heated to no less than the calculated Ts. There is no well defined critical upper limit, but for economy and other obvious reasons it is preferable that the Ts not be exceeded by more than about 25° C., particularly for coated paper.

It is also desirable to limit the depth of the web heated to its Tg to only the critical substrata. The reason is that all portions pressed which are hotter than the Tg will be excessively densified, in the manner of supercalendering, with the accompanying undesirable loss in thickness and opacity. To obtain supercalender quality on the surface, only the critical substrata need be so densified and any additional flatness obtained by heating further into the web will be costly. The greater drum temperature, slower process speed, and/or greater sheet moisture needed to accomplish this reduce process efficiency, may require more expensive equipment and greater energy costs and can have the disadvantages of supercalendering.

Referring again to FIG. 2, another rapid rise in gloss and smoothness on uncoated paper begins to occur at drum surface temperatures beyond about 160° C. (320° F.), about 17° C. (30° F.) above Ts. This discovery is believed to be an invention in itself. It is believed to be thermal molding of another, deeper substrata, perhaps providing a discrete benefit from the first because of the discrete properties of the fibers in the web. It is not known if the same effect can be found in coated paper. Although operating in the range of this additional benefit has the disadvantages mentioned above, it may be valuable to do so when exceptionally high smoothness is desired.

A further surprising and unexpected benefit was obtained from the invention. If one were to theorize the ideal finishing operation to produce glossy paper with the very smooth flat surfaces of supercalender quality, it would be necessary to closely evaluate the control parameters of pressure, temperature, moisture content, and dwell time in the nip. The one most controllable is pressure, because it can be changed precisely and instantaneously. The least controllable is moisture content, since it can be changed only slowly and is often difficult to maintain uniformly. Thus, the ideal process would be one in which large property changes result from small pressure changes and small property changes result from large moisture changes.

The present invention provides control parameters which provide the ideal controls described above and also supercalender quality. These advantages cannot be obtained with supercalendering because its range for control parameters cause pressure to be the least effective control and moisture the most.

The invention is believed applicable for almost any pressure applied in the nip. That is, it is expected that the effects of increasing pressure will follow their known curve, except of course, the results will be significantly better. However, to obtain the most value from the invention, the pressures will preferably be over 13,780 $KN/M^2$ (2000 pounds per square inch). It is at these pressures that supercalender and better quality can be obtained.

Although the most valuable use for the invention is to produce supercalender quality coated paper, the principles of the invention are believed to be applicable to any type of web of papermaking fibers, whether coated or uncoated, groundwood or woodfree. The invention is valuable for woodfree papers (which will be defined herein as having at least 80% of its papermaking fibers provided by chemical pulp), and groundwood papers (which will be defined herein as having at least 50% of its papermaking fiber provided by groundwood pulp) and those in between, which will comprise from 50% to 80% chemical pulp fibers and from 20% to 50% groundwood fibers. Any of these may be coated. Coatings for woodfree sheets preferably will be in an amount of at least 7.5 g/m$^2$ and those for the other sheets preferably will be in an amount of at least 4.5 g/m$^2$. The invention is believed to be applicable to all conventional basis weights, including the heavy weight board products. The invention is capable of producing, at least with the coated woodfree sheets, gloss higher than 50 and even 70, and Parker Print-Surfs better than 1.4 and even better than 1.0.

Although the invention is believed to provide similar advantages to all papermaking fibers, groundwood is believed to provide an additional result because of the large amount of lignin in the web. N. L. Salmen has described lignin as having a static Tg at 115° C. (239° F.) or dynamic Tg of 127° C. (260° F.) for moisture content of 2.5% and above. (See previously cited Salmen and Beck references and also Thermal Softening of the Components of Paper and its Effects on Mechanical Properties, N. L. Salmen, C.P.P.A. 65th Annual Meeting, Feb., 1979, pp. B11–B17.) This value is equivalent to the Tg for Cellulose at a moisture content of 4.7%. A typical groundwood web would have about 30% lignin, causing a similar but perhaps smaller rise in gloss and smoothness when its Tg was reached as with cellulose. A second and probably larger rise would occur when the Tg of the cellulose was reached, which could be at a higher or lower temperature than the Tg of the lignin, depending upon moisture content. Therefore, the invention is also subjecting a groundwood web (at least 50% groundwood) to a drum surface temperature which is at least as high as that calculated by the formula using a moisture content of 4.7%.

What is claimed is:

1. Process for producing gloss and smoothness on a surface of a paper web independent of the gloss and smoothness produced on the other surface of the web, comprising the steps of:

A. providing a finishing apparatus comprising a smooth metal finishing drum and a resilient backing roll pressed against the drum at a force up to 700 KN/M (4000 pounds per lineal inch) to form a nip with pressure against the paper of at least 13,780 KN/M$^2$ (2000 pounds per square inch) and less than 60,000 KN/M$^2$ (8,700 pounds per square inch);

B. advancing a web of papermaking fibers having a moisture content of from 3% to 7% of the bone dry weight of the fibers through the nip at a speed which results in the web dwelling in the nip from 0.3 milliseconds to 12 milliseconds; and C. simultaneously with step B, heating the drum to a surface temperature which is: (i) higher than Ts−20° C. to thermally mold a substrata of the web beneath said surface; and (ii) lower than that which heats the interior of the web sufficiently deep and sufficiently hot to thermally mold the entire thickness of the web and thereby cause the finishing steps applied to one side of the web to significantly affect the gloss and smoothness characteristics imparted to the other side of the web, wherein Ts is determined by the following formula:

$$Ts=[Ti\times 0.357t^{-0.479}-234\cdot 2e^{-131m}]/[0.357t^{-0.479}-1]$$

where:

Ts=surface temperature of the heated drum, in °C.;

Ti=the initial temperature of the web just prior to entering the nip, in °C.;

t=dwell time of the web in the nip, in milliseconds;

e=the base of the natural logarithm; and m=moisture content of the fibers in the web in weight percent of the bone dry fiber weight.

2. Process according to claim 1, wherein the moisture content of the web is substantially uniform throughout the web.

3. Process according to claim 7, wherein the finishing apparatus comprises a second nip formed by a smooth metal finishing drum and a resilient backing roll and through which the web advances within 4 seconds before or after passing through the first nip and with the same side of the web against the drum through both nips.

4. Process according to claim 1, wherein the finishing apparatus comprises an additional nip formed by a second smooth metal finishing drum and a resilient backing roll and through which the web advances with the side of the web against the drum which is opposite from the side against the first drum in the first nip and the temperature of the surface of the drum in the additional nip being determined in the manner in which it is determined for the first nip, making adjustments for a decrease in moisture content between the first and second drum.

5. Process according to claim 1, wherein the web is coated in a continuous in line operation with the finishing steps.

6. Process according to claim 1, wherein the web is formed on a papermaking machine in a continuous operation with the finishing steps.

7. Process according to claim 5, wherein the web is formed on a papermaking machine in a continuous operation with the coating and finishing steps.

8. Process according to claim 1, wherein at least 80% of the papermaking fibers are provided by chemical pulp.

9. Process according to claim 1, wherein at least 50% of the papermaking fibers are provided by groundwood pulp.

10. Process according to claim 9, wherein prior to step B the web is coated on at least one side with a coating composition comprising paper coating pigments and binder in an amount of at least 4.5 g/m$^2$ (3 pounds per ream of 3300 square feet), and the at least one side with a coated composition is against the drum when passing through the nip.

11. Process according to claim 8, wherein prior to step B the web is coated on at least one side with a coating composition comprising paper coating pigments and binder in an amount of at least 7.5 g/m$^2$ (5 pounds per ream of 3300 square feet), and the at least one side with a coated composition is against the drum when passing through the nip.

12. Process according to claim 11, wherein the web produced has a 75° gloss of at least 50 and a Parker Print-Surf value no higher than 1.4 on the at least one side with a coating composition.

13. Process according to claim 12, wherein the web produced has a 75° gloss of at least 70 and a Parker Print-Surf value no higher than 1.0 on the at least one side with a coating composition.

14. Process according to claim 9, wherein the drum surface is heated to a temperature no less than that calculated by the formula set forth in claim 1 using a moisture content of 4.7%.

15. Process according to claim 1, wherein in step B the web does not contact the drum except in the nip or nips.

16. Process according to claim 1, wherein in step B the web does not contact the drum over more than 20% of the drum circumference.

17. Process according to claim 1, wherein the web of papermaking fibers is uncoated and the the drum is heated to a surface temperature of at least $T_s+17°$ C.

* * * * *